US012078178B2

(12) United States Patent
Yoshino et al.

(10) Patent No.: US 12,078,178 B2
(45) Date of Patent: Sep. 3, 2024

(54) VACUUM PUMP AND CONTROL DEVICE

(71) Applicant: Edwards Japan Limited, Yachiyo (JP)

(72) Inventors: Shinichi Yoshino, Yachiyo (JP); Masayuki Takeda, Yachiyo (JP); Naoki Miyasaka, Yachiyo (JP)

(73) Assignee: Edwards Japan Limited, Yachiyo (JP)

( * ) Notice: Subject to any disclaimer, the term of this patent is extended or adjusted under 35 U.S.C. 154(b) by 0 days.

(21) Appl. No.: 18/256,020

(22) PCT Filed: Dec. 21, 2021

(86) PCT No.: PCT/JP2021/047364

§ 371 (c)(1),
(2) Date: Jun. 5, 2023

(87) PCT Pub. No.: WO2022/145292

PCT Pub. Date: Jul. 7, 2022

(65) Prior Publication Data

US 2024/0060496 A1 Feb. 22, 2024

(30) Foreign Application Priority Data

Dec. 28, 2020 (JP) ..... 2020-219429

(51) Int. Cl.
*F04D 19/04* (2006.01)
*F04D 27/00* (2006.01)
(Continued)

(52) U.S. Cl.
CPC ..... *F04D 19/042* (2013.01); *F04D 27/006* (2013.01); *F04D 29/582* (2013.01); *F04D 29/701* (2013.01)

(58) Field of Classification Search
CPC ..... F04D 19/042
See application file for complete search history.

(56) References Cited

U.S. PATENT DOCUMENTS

2018/0066669 A1 3/2018 Tsubokawa

FOREIGN PATENT DOCUMENTS

JP H0878300 A 3/1996
JP H09317688 A 12/1997
(Continued)

OTHER PUBLICATIONS

English translation of JP 2007113455 (Year: 2007).*
International Search Report and Written Opinion of International Application No. PCT/JP2021/047364 dated Feb. 15, 2022, 8 Pages.

*Primary Examiner* — Brian O Peters
(74) *Attorney, Agent, or Firm* — Shumaker & Sieffert, P.A.

(57) ABSTRACT

A vacuum pump and a control device, on a pump side, performs heater control of a pipe to suppress precipitation of a deposit from a process gas and cooling control of a deposit trap to remove the deposit, and perform heater control and cooling control the process gas situation. A temperature sensor is disposed on an outer periphery or an inner periphery of an introduction pipe 3H, outputs temperature information a control device. Temperature information from the inside of a deposit trap is also sent to control device. The control device, performs ON/OFF control a heater such that a temperature of the introduction pipe 3H has a predetermined temperature value, based on the input temperature information 31. The control device, performs opening/closing control on a valve such that an internal temperature of the deposit trap has a predetermined cooling temperature value, based on the input temperature information.

8 Claims, 4 Drawing Sheets

(51) Int. Cl.
*F04D 29/58* (2006.01)
*F04D 29/70* (2006.01)

(56) References Cited

FOREIGN PATENT DOCUMENTS

| | | | |
|---|---|---|---|
| JP | 2007113455 | A | 5/2007 |
| JP | 2018040277 | A | 3/2018 |

* cited by examiner

VACUUM PUMP AND CONTROL DEVICE

This application is a U.S. national phase application under 35 U.S.C. § 371 of international application number PCT/JP2021/047364 filed on Dec. 21, 2021, which claims the benefit of JP application number 2020-219429 filed on Dec. 28, 2020. The entire contents of each of international application number PCT/JP2021/047364 and JP application number 2020-219429 are incorporated herein by reference.

TECHNICAL FIELD

The present disclosure relates to a vacuum pump and a control device, and particularly relates to a vacuum pump and a control device which reduce costs and save space by performing, on a pump side, heater control of a pipe which is performed for suppressing precipitation of a deposit from a process gas and cooling control of a deposit trap in which removal of the deposit is performed, and implement energy saving by performing the heater control and the cooling control corresponding to a situation of the process gas.

BACKGROUND

With evolution of electronics in recent years, demand for semiconductors such as a memory and an integrated circuit has sharply increased.

These semiconductors are manufactured by doping a semiconductor substrate having extremely high purity with an impurity to impart electrical properties to the semiconductor substrate or forming a fine circuit on a semiconductor substrate by etching.

These operations need to be performed in a chamber in a high vacuum state for avoiding an influence by dust in the air or the like. In general, a vacuum pump is used for exhaust of the chamber and, in particular, a turbo-molecular pump which is one of vacuum pumps is often used from the viewpoint of a smaller amount of a residual gas and easier maintenance.

In addition, in manufacturing steps of the semiconductor, there are many steps of causing various process gases to act on a semiconductor substrate, and the turbo-molecular pump is used not only for evacuating the inside of the chamber but also for exhausting the process gases from the chamber.

SUMMARY

To perform the conventional heater control of the pipe 3B and the conventional cooling control of the deposit trap 7, it is desirable to dispose the pipe heater control controller 19 and the refrigerant introduction control controller 17 at sites where the pipe 3B and the deposit trap 7 are placed.

In addition, the heater control and the cooling control are performed irrespective of a situation of an inflow of the process gas, and hence each of the heater control and the cooling control is control based on the assumption that an inflow amount of the process gas is always substantially the maximum inflow amount. Consequently, there is a possibility that excessive operation control may be always performed without considering a load fluctuation even when the inflow amount of the process gas is small or the chamber 1 is in a suspended state.

The present disclosure has been made in view of such a conventional problem, and an object thereof is to provide a vacuum pump and a control device which reduce costs and save space by performing, on a pump side, heater control of a pipe which is performed for suppressing precipitation of a deposit from a process gas and cooling control of a deposit trap in which removal of the deposit is performed, and implement energy saving by performing the heater control and the cooling control corresponding to a situation of the process gas.

Accordingly, the present disclosure (claim 1) is a vacuum pump including: a vacuum pump main body which exhausts a gas in a chamber; and a control device which controls the vacuum pump main body, wherein the control device includes a temperature control means for performing temperature control on at least one of a heating means for heating a pipe connected to a stage subsequent to the vacuum pump main body, and a trap device which is connected to the pipe, generates a deposit from the gas exhausted from the chamber, and removes the deposit.

Maintenance work or the like is not hindered and space is saved correspondingly to absence of a temperature control device for controlling the heating means for heating the pipe and the trap device outside the control device, and a reduction in cost is thereby implemented. Even when a function of controlling the heating means and the trap device is provided in the temperature control means, a size of the control device does not change, and it is made possible for energy consumption to hardly change.

In addition, in the vacuum pump which is the present disclosure (claim 2), the temperature control on the trap device by the temperature control means is performed by adjusting an introduction amount or a set temperature of a refrigerant to the trap device.

It is possible to cool a process gas and efficiently trap a product with the trap device by adjusting the introduction amount or the set temperature of the refrigerant to the trap device.

Further, in the vacuum pump which is the present disclosure (claim 3), the temperature control on the heating means by the temperature control means is performed on an introduction portion to the trap device of the pipe connected to the trap device.

The temperature control of the heating means is performed on the introduction portion to the trap device of the pipe connected to the trap device. With this, the introduction portion is heated by the heating means, and the deposit can be prevented from being deposited in the introduction portion immediately before the trap device. Accordingly, the maintenance work of the trap device is facilitated. In addition, it is possible to increase trap efficiency by reliably depositing the product inside the trap device without depositing the product in the introduction portion.

Further, in the vacuum pump which is the present disclosure (claim 4), the temperature control is performed according to a state of the vacuum pump main body.

The temperature control of the heating means or the trap device needs to be operated only when the process gas flows basically. To cope with this, the flow of the process gas is determined by determining the state of the vacuum pump main body. Subsequently, the temperature control of the heating means or the trap device is performed according to the determined state.

With this, it becomes possible to provide a suspension period of the temperature control or perform control corresponding to a period during which a gas flow rate is low, and energy saving can be thereby implemented.

Further, in the vacuum pump which is the present disclosure (claim 5), activation, stopping, or output adjustment of each of the heating means and the trap device is performed according to the state of the vacuum pump main body.

It is possible to efficiently perform energy saving by performing the activation, stopping, or output adjustment of each of the heating means and the trap device according to the state of the vacuum pump main body.

Further, in the vacuum pump which is the present disclosure (claim 6), the temperature control means includes a base portion temperature control function which performs temperature control of a base portion of the vacuum pump main body.

A temperature control function for the heating means and a temperature control function for the trap device can be integrated at one location of the temperature control means together with the base portion temperature control function, and hence maintenance management is easily performed. In addition, configuration is allowed in a space-saving manner.

Further, the present disclosure (claim 7) is a control device controlling a vacuum pump main body which exhausts a gas in a chamber, the control device including: a temperature control means for performing temperature control on at least one of a heating means for heating a pipe connected to a stage subsequent to the vacuum pump main body, and a trap device which is connected to the pipe, generates a deposit from the gas exhausted from the chamber, and removes the deposit.

As has been described thus far, according to the present disclosure, the control device includes the temperature control means for performing the temperature control on at least one of the heating means for heating the pipe connected to the stage subsequent to the vacuum pump main body, and the trap device which is connected to the pipe, generates the deposit from the gas exhausted from the chamber, and removes the deposit, and hence it is possible to eliminate the temperature control device for controlling the heating means for heating the pipe and the trap device outside the control device. Accordingly, the maintenance work or the like is not hindered and space is saved, and a reduction in cost is thereby implemented.

DETAILED DESCRIPTION

During semiconductor manufacturing, there may be cases where the process gas is introduced to the chamber in a state in which a temperature of the process gas is high for increasing reactivity. In addition, there are cases where the process gases become solid when the process gasses are cooled and reach a given temperature when being exhausted, and a product is thereby precipitated in an exhaust system. Further, there are cases where the process gases of this type are cooled and become solid in the turbo-molecular pump or a pipe leading to an abatement device, and are adhered to and deposited on the inside of the turbo-molecular pump or the pipe.

When a precipitate of the process gas is deposited on the inside of the turbo-molecular pump or the pipe, the deposit narrows a pump flow path to cause a reduction in performance of the turbo-molecular pump or clogging of the pipe.

To reduce these deposits, for the turbo-molecular pump, control of heating by a heater and cooling by a water cooled tube is performed on an area around a base portion, as will be described later.

Figure 4:
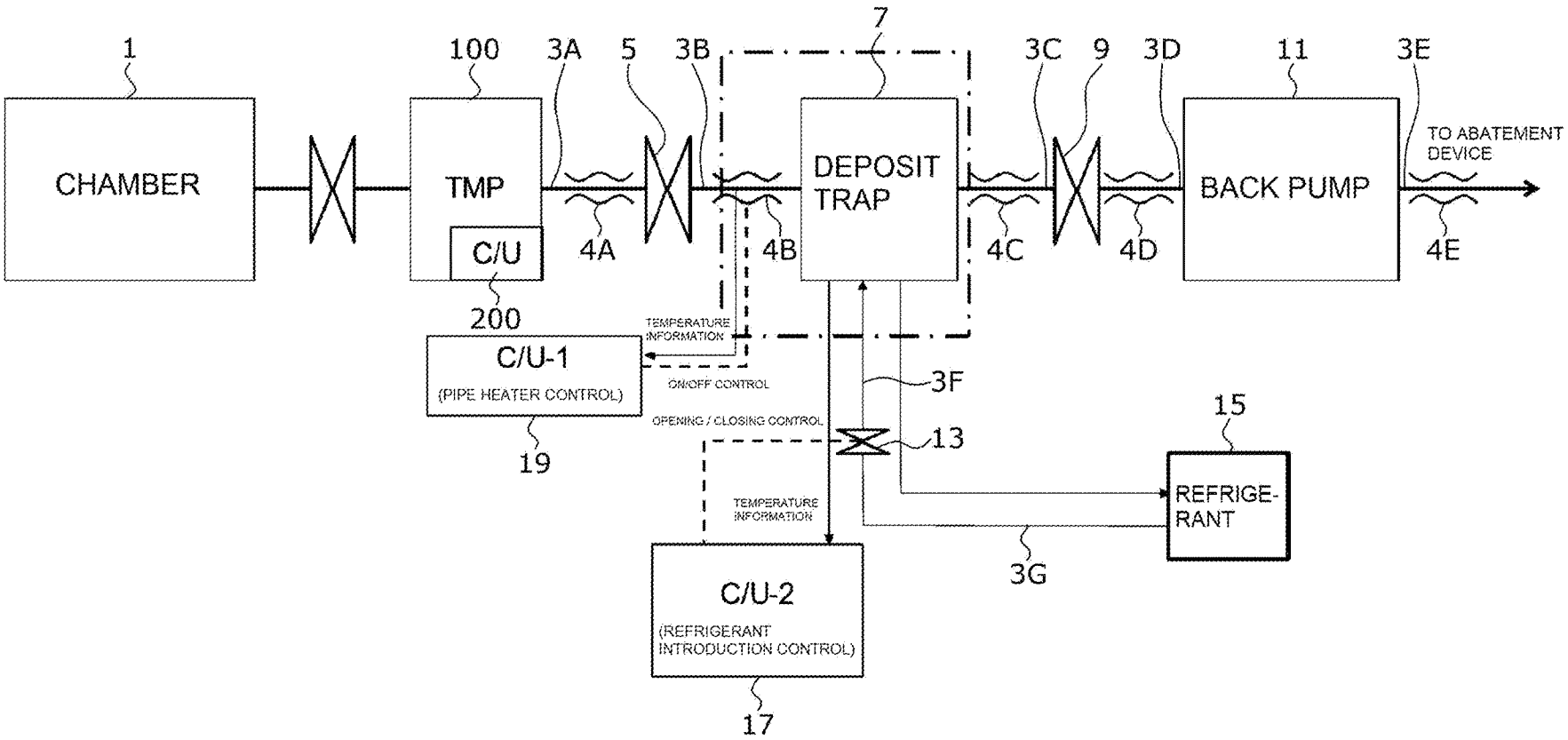
FIG. 4 is a conventional overall block configuration diagram.

On the other hand, for a pipe extending from a downstream side of the turbo-molecular pump to the abatement device, for example, as shown in FIG. 4, temperature management is performed and the pipe is devised to prevent the deposit from being adhered to the pipe.

In FIG. 4, a turbo-molecular pump 100 is connected to a chamber 1, and evacuates the inside of the chamber 1. The turbo-molecular pump 100 is controlled by a control device 200. One end of a pipe 3A is connected to an outlet port of the turbo-molecular pump 100. In addition, one end of a valve 5 is connected to the other end of the pipe 3A, and a deposit trap 7 is disposed at the other end of the valve 5 via a pipe 3B.

A back pump 11 is connected downstream of the deposit trap 7 via a pipe 3C, a valve 9, and a pipe 3D. Further, an abatement device which is not shown is connected downstream of the back pump 11 via a pipe 3E. Heaters 4A, 4B, 4C, 4D, and 4E are wound around outer peripheries of the pipes 3A, 3B, 3C, 3D, and 3E.

In the deposit trap 7, a refrigerant device 15 is connected via a pipe 3F, a valve 13, and a pipe 3G. A temperature sensor which is not shown is disposed inside the deposit trap 7, and temperature information detected by the temperature sensor is input to a refrigerant introduction control controller 17. In the refrigerant introduction control controller 17, a flow rate of a refrigerant flowing to the deposit trap 7 from the refrigerant device 15 is adjusted by performing opening/closing control on the valve 13 such that an internal temperature of the deposit trap 7 has a predetermined cooling temperature value based on the input temperature information.

In addition, a temperature sensor which is not shown is disposed in the pipe 3B, and temperature information detected by the temperature sensor is input to a pipe heater control controller 19. In the pipe heater control controller 19, ON/OFF control is performed on the heater 4B such that a temperature of the pipe 3B has a predetermined temperature value based on the input temperature information. Thus, there are cases where the ON/OFF control is performed only on a specific section such as the heater 4B in a limited manner, and there are cases where the ON/OFF control is performed on all of the heaters 4A, 4B, 4C, 4D, and 4E collectively.

In such a configuration, the process gas is sucked from the chamber 1 by the turbo-molecular pump 100 and the back pump 11. The back pump 11 is used to assist suction of the turbo-molecular pump 100.

The inside of the pipe is caused to have a predetermined high temperature value by actions of the pipe heater control controller 19 and the heater 4B, whereby a state in which the process gas is vaporized is maintained, and hence it becomes difficult for the deposit to be deposited. In addition, the inside of the deposit trap 7 is cooled to have a predetermined low temperature value by actions of the refrigerant introduction control controller 17 and the valve 13, whereby the deposit is precipitated from the process gas, and is trapped inside the deposit trap 7. The process gas from which a gas component deposited (precipitated) as the deposit is trapped (removes) inside the deposit trap 7 is sent to the abatement device and is made harmless.

Figure 1:
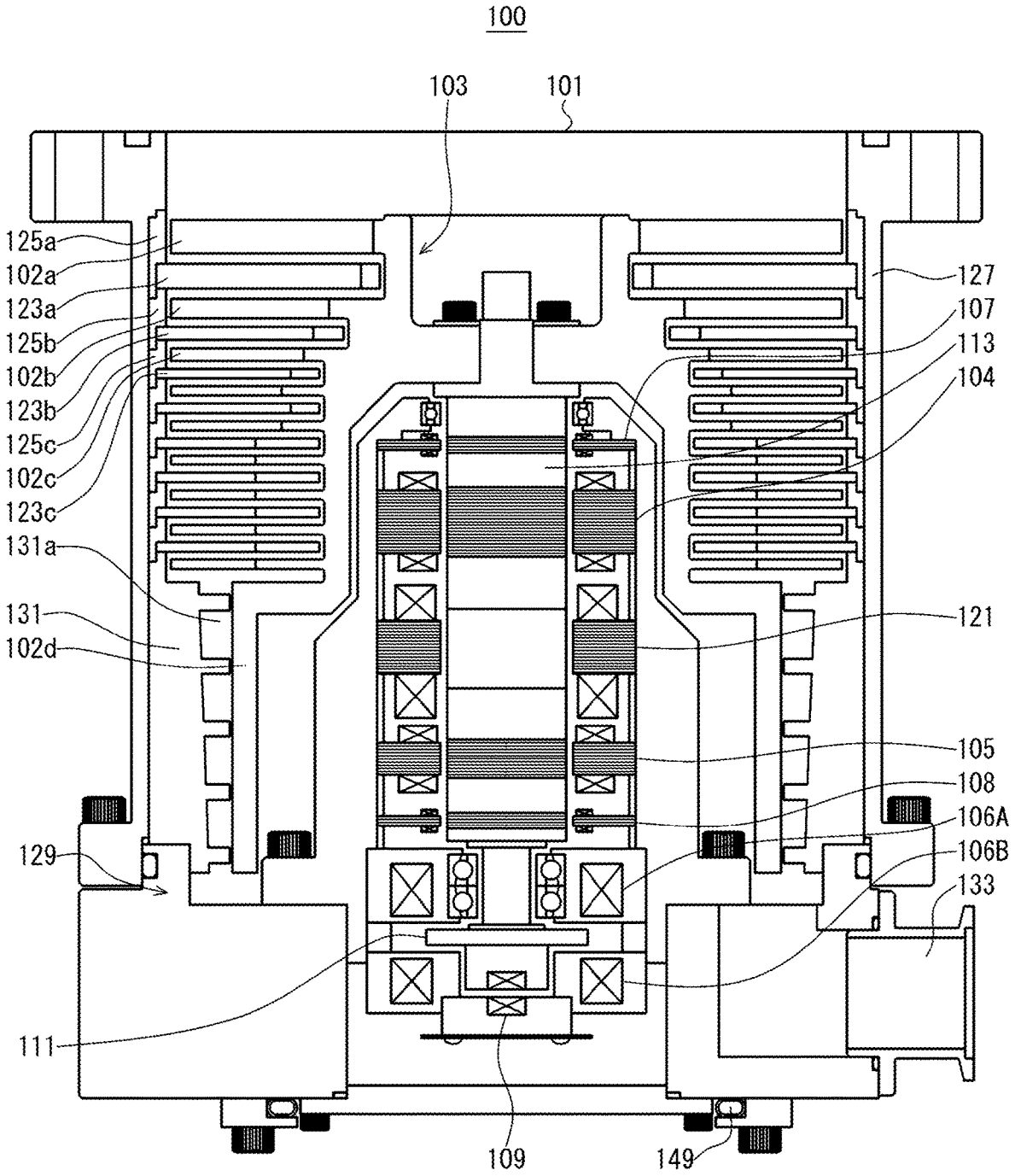
FIG. 1 is a configuration diagram of a turbo-molecular pump used in an example of the present disclosure.

Hereinbelow, an example of the present disclosure will be described. FIG. 1 shows a configuration diagram of a turbo-molecular pump used in the example of the present disclosure. In FIG. 1, in a turbo-molecular pump 100 corresponding to a vacuum pump main body, an inlet port 101 is formed at an upper end of a cylindrical outer tube 127. In addition, inside the outer tube 127, a rotating body 103 in which a plurality of rotor blades 102 (102*a*, 102*b*, 102*c* . . . ) which are turbine blades for sucking and exhausting gas are formed radially in multiple tiers in a peripheral portion is provided. A rotor shaft 113 is attached to the center of the rotating body 103, and the rotor shaft 113 is supported so as to be levitated in the air by, e.g., a five-axis control magnetic bearing and a position of the rotor shaft 113 is controlled also by the five-axis control magnetic bearing. In general, the rotating body 103 is constituted by a metal such as aluminum or an aluminum alloy.

Upper radial electromagnets 104 are disposed such that four electromagnets are paired in an X-axis and a Y-axis. Four upper radial sensors 107 are provided so as to be close to the upper radial electromagnets 104 and correspond to the individual upper radial electromagnets 104. As the upper radial sensor 107, an inductance sensor having, e.g., a conductive winding or an eddy current sensor is used, and the upper radial sensor 107 detects a position of the rotor shaft 113 based on change of inductance of the conductive winding which changes according to the position of the rotor shaft 113. The upper radial sensor 107 is configured to detect a radial displacement of the rotor shaft 113, i.e., the rotating body 103 fixed to the rotor shaft 113, and send the radial displacement thereof to a control device 200.

In the control device 200, for example, a compensation circuit having a PID adjustment function generates an excitation control command signal of the upper radial electromagnet 104 based on a position signal detected by the upper radial sensor 107, and with excitation control being performed on the upper radial electromagnet 104 based on the excitation control command signal, an upper radial position of the rotor shaft 113 is adjusted.

The rotor shaft 113 is formed of a high-permeability material (iron, stainless steel, or the like), and is attracted by magnetic force of the upper radial electromagnet 104. Such adjustment is performed in an X-axis direction and in a Y-axis direction independently. In addition, a lower radial electromagnet 105 and a lower radial sensor 108 are disposed similarly to the upper radial electromagnet 104 and the upper radial sensor 107, and adjust a lower radial position of the rotor shaft 113 similarly to the upper radial position.

Further, axial electromagnets 106A and 106B are disposed so as to vertically sandwich a disc-shaped metal disc 111 provided below the rotor shaft 113. The metal disc 111 is constituted by a high-permeability material such as iron. A configuration is adopted in which an axial sensor 109 is provided for detecting an axial displacement of the rotor shaft 113, and an axial position signal is sent to the control device 200.

In the control device 200, for example, the compensation circuit having the PID adjustment function generates an excitation control command signal of each of the axial electromagnet 106A and the axial electromagnet 106B based on the axial position signal detected by the axial sensor 109, and the amplifier circuit (not shown) performs excitation control on each of the axial electromagnet 106A and the axial electromagnet 106B based on the excitation control command signals, whereby the axial electromagnet 106A attracts the metal disc 111 upward with magnetic force, the axial electromagnet 106B attracts the metal disc 111 downward, and an axial position of the rotor shaft 113 is thereby adjusted.

Thus, the control device 200 properly adjusts the magnetic force exerted on the metal disc 111 by the axial electromagnets 106A and 106B to magnetically levitate the rotor shaft 113 in an axial direction and hold the rotor shaft 113 in space in a non-contact manner.

On the other hand, a motor 121 includes a plurality of magnetic poles which are disposed circumferentially so as to surround the rotor shaft 113. Each magnetic pole is controlled by the control device 200 so as to rotationally drive the rotor shaft 113 via an electromagnetic force acting between the magnetic pole and the rotor shaft 113. In addition, a rotational speed sensor such as, e.g., a Hall element, a resolver, or an encoder which is not shown is incorporated into the motor 121, and a rotational speed of the rotor shaft 113 is detected by a detection signal of the rotational speed sensor.

Further, a phase sensor which is not shown is mounted in the vicinity of, e.g., the lower radial sensor 108, and is configured to detect a phase of rotation of the rotor shaft 113. The control device 200 is configured to detect a position of the magnetic pole by using detection signals of both of the phase sensor and the rotational speed sensor.

A plurality of stator blades 123 (123*a*, 123*b*, 123*c* . . . ) are provided so as to be slightly spaced from the rotor blades 102 (102*a*, 102*b*, 102*c* . . . ). Each of the rotor blades 102 (102*a*, 102*b*, 102*c* . . . ) transfers a molecule of exhaust gas downward by collision, and hence each of the rotor blades 102 is formed so as to be inclined from a plane perpendicular to an axis of the rotor shaft 113 by a predetermined angle. The stator blades 123 (123*a*, 123*b*, 123*c* . . . ) are constituted by a metal such as, e.g., aluminum, iron, stainless steel, or copper, or metals such as alloys containing these metals as ingredients.

In addition, similarly, each of the stator blades 123 is also formed so as to be inclined from the plane perpendicular to the axis of the rotor shaft 113 by a predetermined angle, and the stator blades 123 are disposed so as to extend toward an inner side of the outer tube 127 and alternate with tiers of the rotor blades 102. Further, outer peripheral ends of the stator blades 123 are supported in a state in which the outer peripheral ends thereof are inserted between a plurality of stator blade spacers 125 (125*a*, 125*b*, 125*c* . . . ) which are stacked on each other.

Each of the stator blade spacers 125 is a ring-shaped member, and is constituted by a metal such as, e.g., aluminum, iron, stainless steel, or copper, or metals such as alloys containing these metals as ingredients. Outer tubes 127 are fixed to outer peripheries of the stator blade spacers 125 so as to be slightly spaced from the outer peripheries thereof. A base portion 129 is disposed at a bottom portion of the outer tube 127. In addition, an outlet port 133 is formed to the base portion 129, and is caused to communicate with the outside. Exhaust gas which has entered the inlet port 101 from a side of a chamber (vacuum chamber) and has been transferred to the base portion 129 is sent to the outlet port 133.

Further, depending on usage of the turbo-molecular pump 100, a threaded spacer 131 is disposed between a portion below the stator blade spacer 125 and the base portion 129. The threaded spacer 131 is a cylindrical member constituted by metals such as aluminum, copper, stainless steel, iron, or alloys containing these metals as ingredients, and a spiral thread groove 131*a* having a plurality of threads is formed in an inner peripheral surface of the threaded spacer 131. A direction of the spiral of the thread groove 131*a* is a direction in which, when the molecule of the exhaust gas moves in a rotation direction of the rotating body 103, this molecule is transferred toward the outlet port 133. At the lowest portion of the rotating body 103 subsequent to the rotor blades 102 (102*a*, 102*b*, 102*c* . . . ), a cylindrical portion 102*d* is disposed so as to extend downward. An outer peripheral surface of the cylindrical portion 102*d* is cylindrical, is protruded toward the inner peripheral surface of the threaded spacer 131, and is disposed close to the inner peripheral surface of the threaded spacer 131 with a predetermined gap formed between the outer peripheral surface thereof and the inner peripheral surface thereof. The exhaust gas having been transferred to the thread groove 131*a* by the rotor blades 102 and the stator blades 123 is sent to the base portion 129 while being guided by the thread groove 131*a*.

The base portion 129 is a disc-shaped member constituting a base bottom portion of the turbo-molecular pump 100 and, in general, the base portion 129 is constituted by a metal such as iron, aluminum, or stainless steel. The base portion 129 physically holds the turbo-molecular pump 100 and also has a function of a heat conductive path, and hence it is preferable to use a metal having rigidity of iron, aluminum, or copper and having high heat conductivity.

In such a configuration, when the rotor blade 102 is rotationally driven together with the rotor shaft 113 by the motor 121, the exhaust gas is sucked from the chamber through the inlet port 101 by actions of the rotor blade 102 and the stator blade 123. The rotational speed of the rotor blade 102 is usually 20000 rpm to 90000 rpm, and a circumferential velocity at a tip of the rotor blade 102 reaches 200 m/s to 400 m/s. The exhaust gas sucked from the inlet port 101 passes between the rotor blade 102 and the stator blade 123 and is transferred to the base portion 129. At this point, a temperature of the rotor blade 102 rises due to frictional heat generated when the exhaust gas comes into contact with the rotor blade 102 and conduction of heat generated in the motor 121, and this heat is transmitted to a side of the stator blade 123 by radiation or conduction by a gas molecule of the exhaust gas.

The stator blade spacers 125 are bonded to each other at their outer peripheral portions, and transmit heat received from the rotor blade 102 by the stator blade 123 and frictional heat generated when the exhaust gas comes into contact with the stator blade 123 to the outside.

Incidentally, in a manufacturing process of a semiconductor, some process gases introduced into a chamber have properties which make the process gases solid when pressure of the process gases becomes higher than a predetermined value or temperature of the process gases becomes lower than a predetermined value. Inside the turbo-molecular pump 100, pressure of the exhaust gas is minimized at the inlet port 101 and is maximized at the outlet port 133. When the pressure of the process gas becomes higher than a predetermined value or the temperature thereof becomes lower than a predetermined value during transfer of the process gas from the inlet port 101 to the outlet port 133, the process gas becomes solid, and is adhered to and deposited on the inside of the turbo-molecular pump 100.

For example, in the case where $SiCl_4$ is used as a process gas in an Al etching device, it can be seen that a solid product (e.g., $AlCl_3$) is precipitated at a low degree of vacuum (760 [torr] to $10^{-2}$ [torr]) and at a low temperature (about 20 [° C.]) and the solid product is adhered to and deposited on the inside of the turbo-molecular pump 100. With this, when the precipitate of the process gas is deposited on the inside of the turbo-molecular pump 100, the deposit narrows a pump flow path and becomes a cause of a reduction in performance of the turbo-molecular pump 100. In addition, the above-described product is in a situation in which the product is easily coagulated and adhered in a portion in which pressure is high in the vicinity of the outlet port 133 or in the vicinity of the threaded spacer 131.

Accordingly, in order to solve the problem, a heater which is not shown or an annular water cooled tube 149 is wound around an outer periphery of the base portion 129 or the like, a temperature sensor (e.g., a thermistor) which is not shown is also embedded in, e.g., the base portion 129, and heating by the heater and cooling by the water cooled tube 149 are performed by TMS control (Temperature Management System) such that a temperature of the base portion 129 is maintained at a constant high temperature (set temperature) based on a signal of the temperature sensor.

Figure 2:
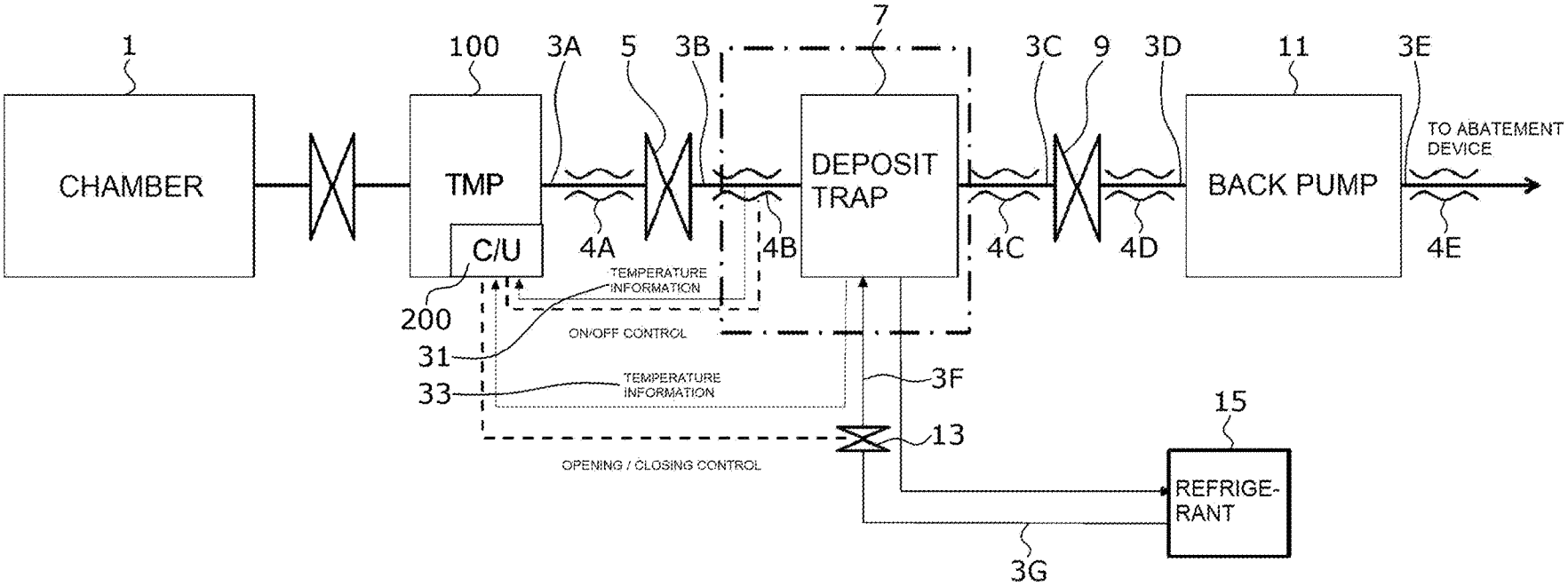
FIG. 2 is an overall block configuration diagram of the example of the present disclosure.

Next, FIG. 2 shows an overall block configuration diagram of the example of the present disclosure. Note that the same elements as those in FIG. 4 are designated by the same reference numerals and description thereof will be omitted.

Figure 3:
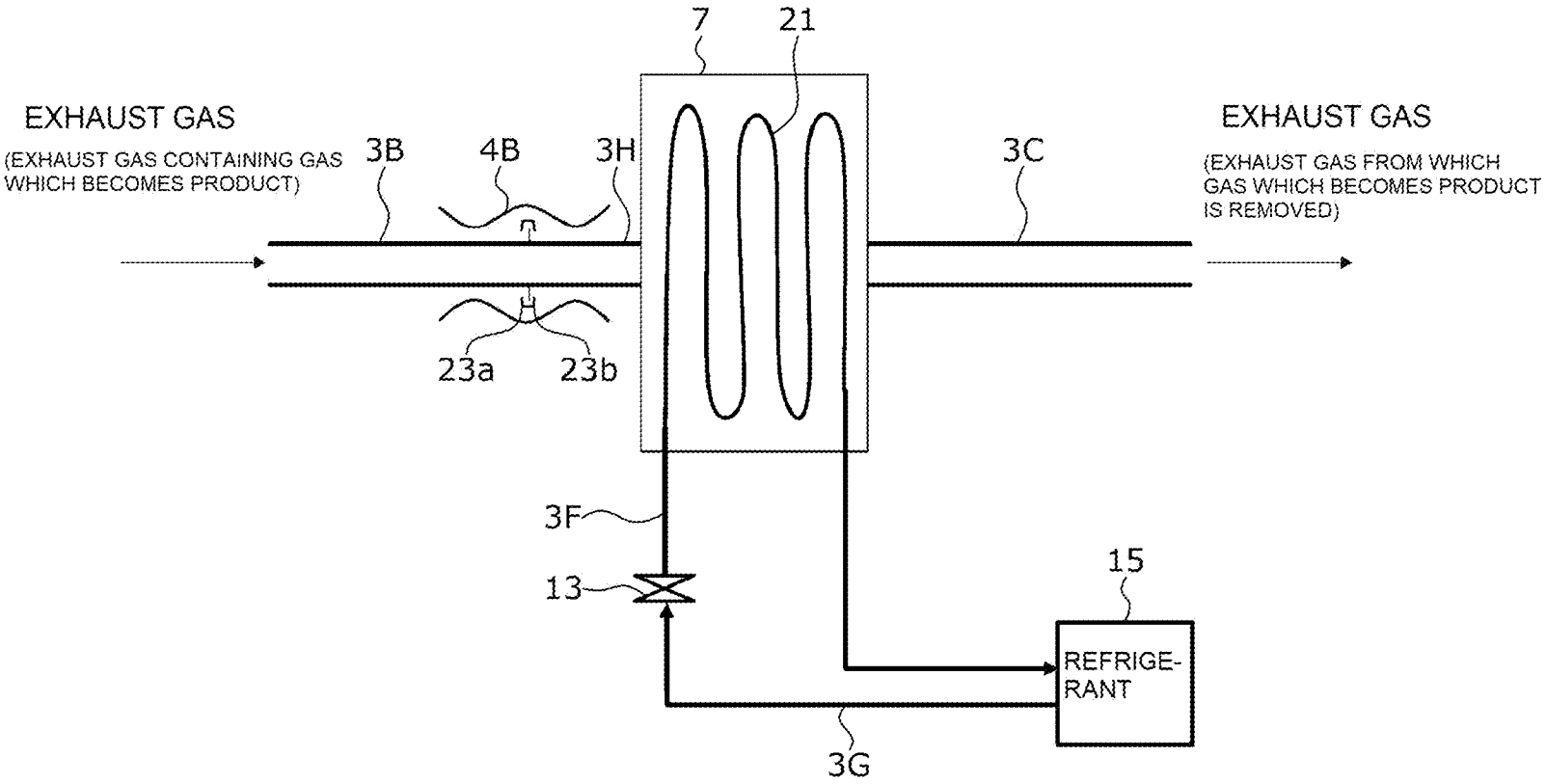
FIG. 3 is an enlarged view of an area around a deposit trap.

In FIG. 2, the refrigerant introduction control controller 17 and the pipe heater control controller 19 disposed in FIG. 4 are omitted. In addition, FIG. 3 shows an enlarged view of an area around a deposit trap 7. A flange 23*a* is attached to a right end of a pipe 3B, and the flange 23*a* is fixed to a flange 23*b* attached to a left end of an introduction pipe 3H corresponding to an introduction portion of the deposit trap 7.

A temperature sensor which is not shown is disposed on an outer periphery or an inner periphery of the introduction pipe 3H, and temperature information 31 detected by the temperature sensor is input to the control device 200. It is desirable that a heater 4B is disposed so as to cover an outer peripheral portion of the introduction pipe 3H.

In the control device 200, ON/OFF control is performed on the heater 4B such that a temperature of the introduction pipe 3H has a predetermined temperature value based on the input temperature information 31. Note that the temperature sensor may also be disposed on an outer periphery or an inner periphery of the pipe 3B. In this case, a position of temperature detection is shifted from a portion of the introduction pipe 3H which is a temperature control target portion, and hence accuracy of temperature control is reduced to an extent, but it is possible to perform the control.

On the other hand, the deposit trap 7 cools its internal space with a refrigerant. In addition, a process gas passes through the space through a trap portion 21 and is cooled, whereby, among gases contained in the process gas, a gas which corresponds to a solid area in a vapor pressure curve is precipitated as a precipitate, and a deposit is generated and is adhered to the inside of a device. Temperature information 33 detected from the inside of the deposit trap 7 is also input to the control device 200. In the control device 200, a flow rate of the refrigerant flowing from the refrigerant device 15 is adjusted by performing opening/closing control on the valve 13 such that an internal temperature of the deposit trap 7 has a predetermined cooling temperature value based on the input temperature information 33.

Next, an operation of the example of the present disclosure will be described.

Conventionally, as shown in FIG. 4, irrespective of control of the turbo-molecular pump 100, the temperature control of the heater 4B is performed by the pipe heater control controller 19 which is an individual controller and the temperature control of the deposit trap 7 is performed by the refrigerant introduction control controller 17.

Consequently, the temperature control of the pipe uses one temperature control device, and the control of the deposit trap uses another temperature control device. In the case where the temperature control is performed separately for each block, there are cases where a plurality of temperature control devices corresponding to the number of blocks may be used.

In the present disclosure, as shown in FIG. 2 and FIG. 3, these temperature control devices are eliminated, and the temperature information 31 detected on the outer periphery or the inner periphery of the introduction pipe 3H and the temperature information 33 detected inside the deposit trap 7 are input to the control device 200 of the turbo-molecular pump 100. The turbo-molecular pump 100 and the control device 200 may be structured to be integral with each other, or may also be separate devices which are independent of each other.

A temperature control portion in the control device 200 which is not shown includes a pipe heater control function and a refrigerant introduction control function. The temperature control portion corresponds to a temperature control means. Note that the TMS control may also be provided in the temperature control portion.

In the pipe heater control function, the ON/OFF control is performed on the heater 4B such that the temperature of the introduction pipe 3H has a predetermined temperature value based on the input temperature information 31. The ON/OFF control may be performed only on a specific section such as the heater 4B in a limited manner, or the ON/OFF control may also be performed on all of the heaters 4A, 4B, 4C, 4D, and 4E collectively. In addition, heaters which are not shown may be disposed for the valves 5 and 9, and the ON/OFF control may be performed on the heaters similarly.

With this, the introduction pipe 3H is heated by the heater 4B, and a product can be thereby prevented from being deposited in the introduction pipe portion immediately before the deposit trap 7. In the case where a temperature in the portion of the introduction pipe 3H is low, the product is deposited at this location. In this case, a pipe conduit of the introduction pipe 3H is clogged and the maintenance work of the deposit trap 7 becomes troublesome. However, as in the present example, by preventing the product from being deposited in the portion of the introduction pipe 3H, the maintenance work of the deposit trap 7 is facilitated. In addition, it is possible to increase trap efficiency by reliably depositing the product inside the deposit trap 7 without depositing the product in the introduction pipe portion.

Note that the same applies to the case where control of the heaters 4A, 4C, 4D, and 4E for the pipes 3A, 3C, 3D, and 3E is performed, and it is desirable that the temperature information detected from the outer peripheries or the inner peripheries of the pipes 3A, 3C, 3D, and 3E is input to the control device 200, temperature adjustment is performed on each of the pipes 3A, 3C, 3D, and 3E, and an ON/OFF control signal is output to each of the heaters 4A, 4C, 4D, and 4E from the control device 200.

On the other hand, in the refrigerant introduction control function, the flow rate of the refrigerant flowing from the refrigerant device 15 is adjusted by performing the opening/closing control on the valve 13 such that the internal temperature of the deposit trap 7 has a predetermined cooling temperature value based on the input temperature information 33.

In the temperature control portion, the control may be performed by using an analog signal without converting the analog signal, but arithmetic calculation may be performed by, e.g., a digital signal processor (DSP) after each temperature information is subjected to analog/digital conversion. Even in the case where the control is performed by using the analog signal without converting the analog signal, configuration is allowed in a space-saving manner. However, in the case where the arithmetic calculation is performed digitally, it is possible to incorporate logic of the pipe heater control function and the refrigerant introduction control function by using a DSP device in which the TMS control is performed conventionally without altering the DSP device. In addition, it is possible to use available terminals of the conventional TMS control as an input terminal of the temperature information 31 and the temperature information 33 and an output terminal for the temperature control. The pipe heater control function, the refrigerant introduction control function, and a cable terminal of the TMS control can be integrated as a temperature control system. Accordingly, the size of the control device 200 does not change, and energy consumption hardly changes. The maintenance work or the like is not hindered and space is saved correspondingly to the absence of the temperature control device at the site, and a reduction in cost is thereby implemented.

Further, the function and the terminal of the temperature control are integrated at one location, and hence maintenance management is facilitated. A temperature control operation panel can also be used in common at the same location.

Next, a description will be given of a method of performing the pipe heater control and the refrigerant introduction control while considering an operation situation of the turbo-molecular pump.

It is considered that, basically, the deposit trap 7 needs to be operated only when the process gas comes. To continuously operate the deposit trap 7 in a state in which the process gas is not present is waste of energy. Accordingly, it is desirable to determine whether or not the process gas flows in the pipe and operate the deposit trap 7 only when the process gas flows. It is determined whether or not the process gas flows in the pipe in the following manner.

That is, in a state in which rated operation of the turbo-molecular pump 100 is performed, it is possible to determine that a situation in which the process gas comes at any moment is established. In this state, the deposit trap 7 is activated such that a deposit or a gas component precipitated as the deposit is removed at any time.

On the other hand, when the motor 121 is activated or stopped, or the rotating body 103 is statically levitated by using the upper radial electromagnet 104 and the upper radial sensor 107, the lower radial electromagnet 105 and the lower radial sensor 108, and the axial electromagnets 106A and 106B and the axial sensor 109 in the turbo-molecular pump 100, output of the deposit trap 7 is reduced or the deposit trap 7 is stopped. In this stop, a compressor which drives the refrigerant device 15 and is not shown may be stopped.

Alternatively, the output of the deposit trap 7 may also be adjusted according to magnitude of a motor current flowing in the motor 121. In this case, an amount of the process gas flowing in the pipe is estimated by using the magnitude of the motor current. At this point, the temperature control portion reads the amount of the process gas flowing in the pipe from a two-dimensional table determined in advance by, e.g., an experiment or the like based on the detected magnitude of the motor current. Subsequently, according to the estimated amount of the process gas, an amount of a refrigerant gas caused to flow from the refrigerant device 15 by performing the opening/closing control on the valve 13 may be determined.

That is, when the chamber 1 is stopped or a state in which the process gas hardly comes continues, it is possible to implement energy saving by reducing the amount of the refrigerant gas caused to flow to the deposit trap 7 from the refrigerant device 15 with the valve 13 or stopping the deposit trap 7.

Similarly, with regard to the temperature of the introduction pipe 3H or the like, in the state in which the rated operation of the turbo-molecular pump 100 is performed, the heater 4B is turned ON and temperature is thereby increased and, when the motor 121 is activated or stopped or the rotating body 103 is statically levitated, temperature may be reduced or the heater 4B may be turned OFF. In addition, the magnitude of a current flowing to the heater 4B may also be controlled according to the magnitude of the motor current flowing in the motor 121. In this case as well, energy saving is implemented.

Alternatively, instead of the flow rate of the refrigerant gas, a temperature of the refrigerant gas or cooling water flowing in the pipe 3G may also be controlled based on the temperature information 33 by changing a structure of the refrigerant device 15 into a chiller structure. Note that both of the flow rate and the temperature of the refrigerant gas may also be controlled.

In addition, the configuration of the deposit trap 7 is not limited to the above configuration. For example, in the vicinity of the trap portion 21, a filter which traps a product cooled and precipitated in the trap portion 21 may also be provided. Alternatively, the filter may also be configured independently of the trap portion 21. Further, a configuration may also be adopted in which the refrigerant device 15 is not provided and only the filter is used instead of the deposit trap 7. Also in the case where the temperature control device such as the refrigerant device 15 is not provided in the deposit trap 7, the effects of the disclosure are achieved also by performing control of output devices related to the pipes 3A, 3B, 3C, 3D, and 3E, the valves 5 and 9, and the deposit trap 7.

Note that the present disclosure can be variously modified without departing from the spirit of the present disclosure, and it goes without saying that the present disclosure includes all such modifications.

The invention claimed is:

1. A vacuum pump comprising:

a vacuum pump main body which exhausts a gas in a chamber; and a control device which controls the vacuum pump main body, wherein:

the control device executes:

a first temperature control for heating a pipe connected to a stage subsequent to the vacuum pump main body by a heater attached on the pipe, and a second temperature control for cooling a trap device with a refrigerant, the trap device connected to the pipe, wherein the trap device is configured to generate a deposit from the gas exhausted from the chamber to remove the deposit.

2. The vacuum pump according to claim 1, wherein:

the second temperature control on the trap device by the control device is performed by adjusting an introduction amount or a set temperature of the refrigerant to the trap device.

3. The vacuum pump according to claim 1, wherein:

the first temperature control on the heater by the control device is performed on an introduction portion to the trap device of the pipe connected to the trap device.

4. The vacuum pump according to claim 1, wherein:

the first temperature control and the second temperature control are performed according to a state of the vacuum pump main body.

5. The vacuum pump according to claim 1, wherein:

activation, stopping, or output adjustment of the heater and the trap device is performed according to the state of the vacuum pump main body.

6. The vacuum pump according to claim 1, wherein:

the control device performs temperature control of a base portion of the vacuum pump main body.

7. A control device for controlling a vacuum pump main body which exhausts a gas in a chamber, the control device comprising:

a first temperature control for heating a pipe connected to a stage subsequent to the vacuum pump main body by a heater attached on the pipe, and a second temperature control for cooling a trap device with a refrigerant, the trap device connected to the pipe, wherein the trap device is configured to generate a deposit from the gas exhausted from the chamber to remove the deposit.

8. The vacuum pump according to claim 1, wherein:

the control device further executes a control on the vacuum pump main body, the first temperature control on the heater, and the second temperature control on the trap device.

* * * * *